US006112439A

United States Patent [19]

Rinker

[11] Patent Number: 6,112,439

[45] Date of Patent: Sep. 5, 2000

[54] SUCTION DREDGE

[76] Inventor: Karl Rinker, Im Kirchbrändel 15, D-76669 Bad Schönborn, Germany

[21] Appl. No.: 09/066,915

[22] Filed: Apr. 28, 1998

[30] Foreign Application Priority Data

May 3, 1997 [DE] Germany ..... 197 18 868

[51] Int. Cl.[7] ..... E02F 3/92

[52] U.S. Cl. ..... 37/305; 37/321; 37/324

[58] Field of Search ..... 37/305, 317, 321, 37/324, 334, 335, 336

[56] References Cited

U.S. PATENT DOCUMENTS

| | | | |
|---|---|---|---|
| 3,307,278 | 3/1967 | Bodine, Jr. . | |
| 3,585,739 | 6/1971 | De Koning . | |
| 3,930,324 | 1/1976 | Wightman et al. | 37/189 |
| 4,624,066 | 11/1986 | Heuvelman . | |
| 4,776,731 | 10/1988 | Briggs et al. . | |
| 4,936,031 | 6/1990 | Briggs et al. | 37/80 R |
| 5,195,852 | 3/1993 | Malugani et al. . | |
| 5,408,766 | 4/1995 | Pobihushchy . | |
| 5,425,188 | 6/1995 | Rinker . | |
| 5,487,229 | 1/1996 | Nathenson et al. | 37/347 |
| 5,791,073 | 8/1998 | Palmer . | |

FOREIGN PATENT DOCUMENTS

| | | |
|---|---|---|
| 0368129 | 5/1990 | European Pat. Off. . |
| 2853841 | 7/1980 | Germany . |

*Primary Examiner*—H. Shackelford
*Attorney, Agent, or Firm*—Antonelli, Terry, Stout & Kraus, LLP

[57] ABSTRACT

A suction dredge for the planned taking up of suction material, particularly for excavating soil from underground pipes, has a pneumatic suction hose for taking up the suction material and at whose lower end is provided a suction stub. At its opposite, upper end the suction hose issues into a collecting tank. To simplify the handling of the suction stub, it is provided with a guide body fitted to the suction hose and a suction nozzle axially movable relative thereto and which by means of a drive mechanism can be retracted into and extended from the guide body. As a result the stroke frequency of the suction nozzle and/or its stroke length and/or the impact energy on the soil can be adjusted.

17 Claims, 2 Drawing Sheets

SUCTION DREDGE

BACKGROUND OF THE INVENTION

1. Field of the Invention

The invention relates to a suction dredge or dredger for the planned taking up of suction material, particularly for excavating soil from underground pipes, having a pneumatic suction hose for taking up the suction material and on whose lower end is provided a suction stub and which issues at its opposite end into a collecting tank.

2. Description of the Prior Art

When working on pipes or lines laid underground, use is frequently made of shovel dredges in pipeline construction, but this is particularly disadvantageous if it is a question of exposing a specific point of the underground pipes, in order to e.g. remove pipe breaks, connect branch pipes or merely inspect the pipes. As a result of the operation of a shovel dredge, a considerable soil area must be removed and the overburden deposited on the building site. As a result of the relatively rough operation and poor controllability of the shovel, there is a considerable risk of damaging the pipes to be exposed or neighbouring pipes. In the case of medium-carrying pipes, such as gas, water or sewage pipes, this can lead to an escape of the medium and in the case of electric cables to the destruction of the latter.

In order to avoid the aforementioned disadvantages, so-called suction dredges have been developed for the planned removal of suction material, in which with the aid of a blower a vacuum is produced and the suction material can be sucked into a collecting tank by means of a suction hose, which hangs on a cantilever arm and can be moved in all directions. The suction material is separated there from the suction air flow, whilst dust or other particles still present in the transport air are filtered out, before the air is blown off at the blower outlet side.

It has been found that the suction capacity of a suction dredge when used in soil excavation is to a significant extent dependent on the skill of the operator. A high suction capacity is obtained if the stroke movement of the suction stub located on the free, lower end of the suction hose can be adapted as regards the stroke frequency, i.e. the number of strokes per minute, and the residence time on the ground, i.e. the actual suction time, both differing as a function of the material to be taken up, to the consistency of the particular material to be sucked up. The operator is usually overburdened, because apart from controlling the vertical up and down movement of the suction stub, he must also pay attention to the point where the suction stub during the downward movement should appropriately be placed on the ground.

SUMMARY OF THE INVENTION

The invention provides a suction dredge for the planned taking up of suction material, particularly for soil excavation, where the handling of the suction stub is simplified for the operator.

The problem is of the prior art solved by a suction stub having a guide body fitted to a suction hose and a suction nozzle axially movable relative thereto and which can be drawn into and extended out of the guide body by means of a drive mechanism.

Thus, according to the invention, the vertical up and down movement of the suction stub is automated, so that the operator can concentrate on the point where the suction nozzle is placed on the ground, so that the operation of the suction dredge is significantly facilitated and simultaneously a high suction capacity can be obtained.

The movement of the suction nozzle relative to the guide body can be continuous or intermittent. However, preferably, the stroke frequency, i.e. the number of strokes of the suction nozzle per minute, its stroke length and also its impact energy on the ground can be varied and in particular adjusted by the operator, in order to bring about a good adaptation to the materials present at the place of use. This can in particular be achieved by a programmable or programmed control and for different soil types it is possible to store in a memory the optimum parameter configuration for the stroke frequency, stroke length and impact energy of the suction nozzle, so that the operator need merely select by means of a selector switch on a console the corresponding soil type.

During its axial movement relative to the guide body, the suction nozzle is guided on the latter and for this purpose, in known manner, guide rings or ledges can be provided.

To facilitate the handling of the guide body for the operator, the guide body is provided with a grip or handle, which is preferably constructed as a spatial gripping frame surrounding the guide body, so that on the one hand the grip is given a high spatial stability and on the other it serves as an external protection cage for the additional devices, e.g. hydraulic lines, drive mechanisms, etc., which are optionally externally fitted to the guide body.

When working in the soil there is a risk of in error exposing and damaging live cables. To protect the operator in such cases against electric shocks, according to a further development of the invention, the guide body and/or grip is electrically insulated against the suction nozzle.

As a drive mechanism for the suction nozzle a piston-cylinder unit has proved advantageous and it can either be a compressed air or a hydraulic cylinder. In order to protect the piston-cylinder unit against external, undesired loads and in particular against dirt, it can be surrounded by a protective cover. In order to modify the impact energy of the suction nozzle on the ground, with the piston-cylinder unit is associated one or more adjustable boosters which, as a function of the materials to be sucked up, can either be connected in or disconnected.

On the suction nozzle can be provided a sensor, by means of which the penetration depth of the suction nozzle into the soil to be taken up can be detected. The sensor delivers a corresponding penetration signal to the control device. If the control device establishes that the penetration depth is inadequate and consequently the soil too hard, it correspondingly automatically switches in the booster or provides the suction stub operator with an optical and/or acoustic signal, so that the operator manually connects in the booster.

At its lower end engaging in the soil, in known manner the suction nozzle has a tooth system for soil loosening purposes. However, if a risk exists during the suction of the soil of damaging exposed cables, the suction nozzle tooth system can be covered with a cap, which is preferably fitted in pivotable or removable manner to the suction nozzle.

BRIEF DESCRIPTION OF THE DRAWINGS

Further details and features of the invention can be gathered from the following description of an embodiment with reference to the attached drawings, wherein show.

DETAILED DESCRIPTION OF THE DRAWINGS

Figure 1:
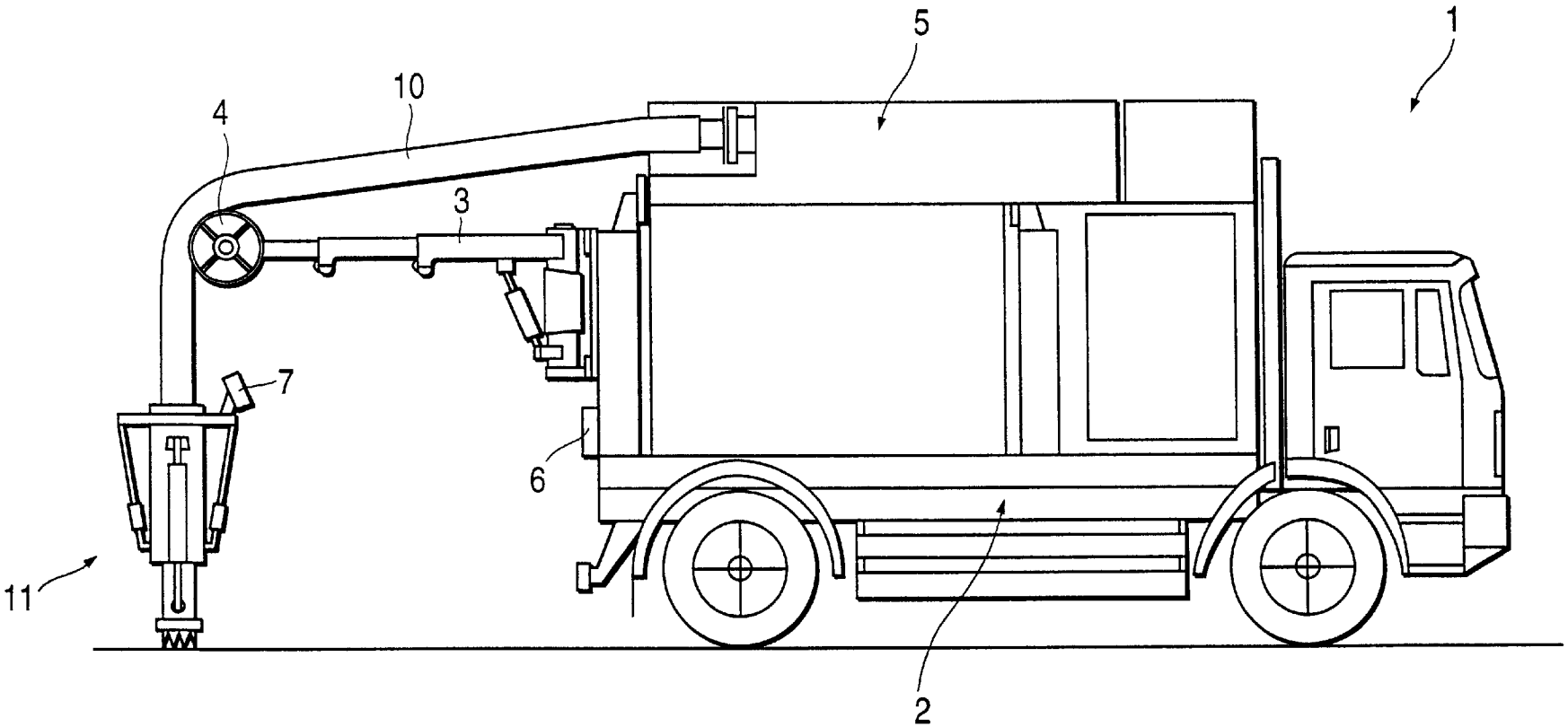
FIG. 1 A side view of a suction dredge.

FIG. 1 is a side view of a suction dredge 1, which has a running gear 2, on which are mounted the conventional structures or superstructures, e.g. a collecting tank 5. On the rear end of the structures is provided a pivotable telescopic arm 3, which terminates in a guide pulley 4. Into the collecting tank 5 issues a pneumatic suction hose 10, which passes over the guide pulley 4 and carries at its lower end a suction stub 11. By means of a vacuum a suction medium, normally soil, is taken up with the aid of the suction stub 11 and transported through the suction hose 10 into the collecting tank 5.

Figure 2:
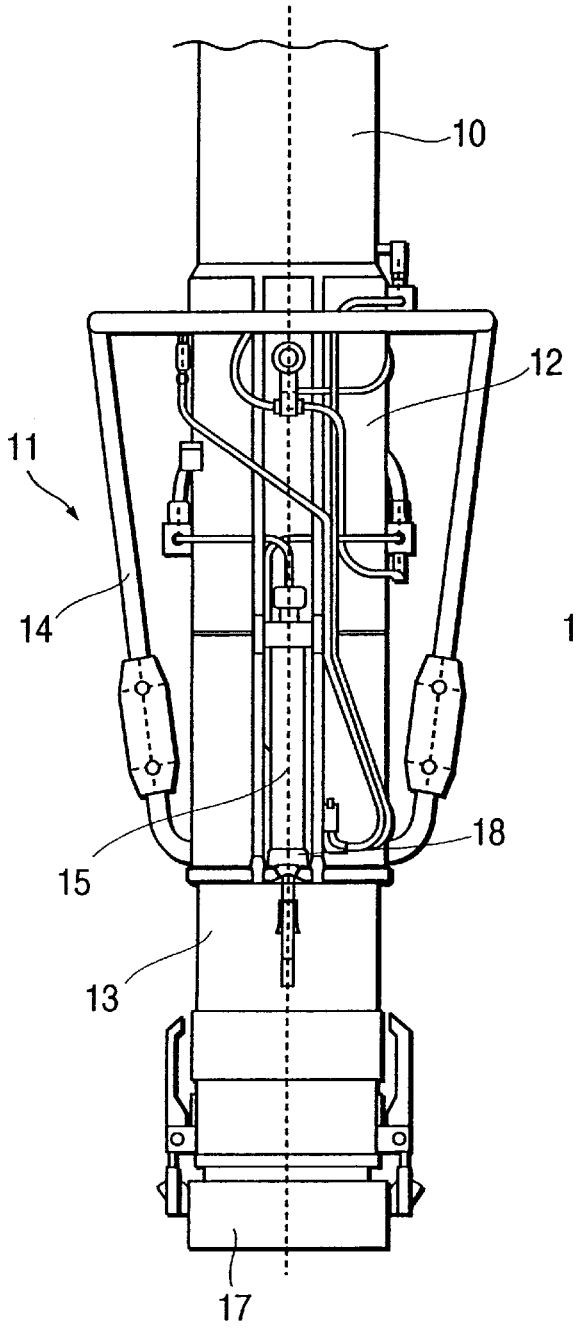
FIG. 2 An inventive suction stub with a retracted suction nozzle.
Figure 3:
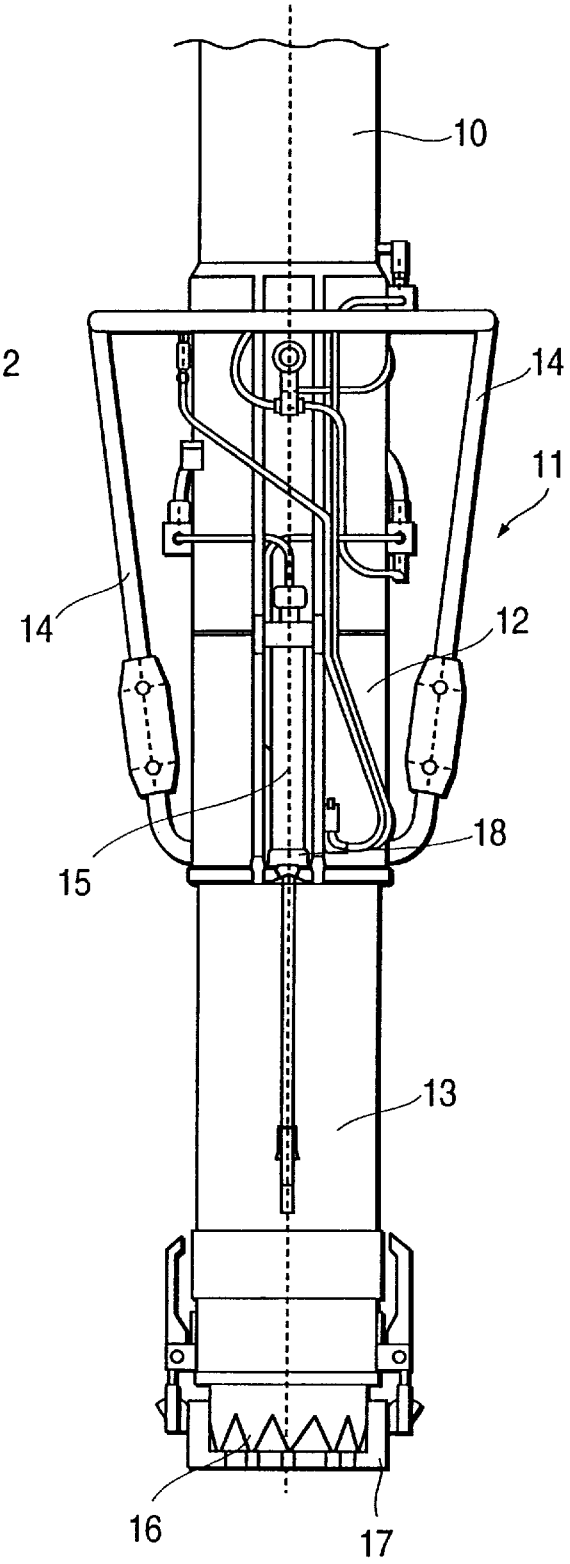
FIG. 3 The suction stub according to FIG. 1 with the suction nozzle extended.

The suction stub 11 shown in detail in FIGS. 2 and 3 and which is connected to the lower end of the pneumatic suction hose 10, comprises a tubular guide body 12 connected to the suction hose 10 and which is externally surrounded by a gripping frame 14. An operator can grip the guide body 12 by the gripping frame 14 and freely move it horizontally and/or vertically in known manner together with the suction hose 10 and it is supported by the pivotable telescopic arm 3.

A tubular suction nozzle 13 is inserted at the lower end of the guide body 12 and it can be axially inserted in and axially extended from the guide body 12. The drive for the movement of the suction nozzle 13 is constituted by at least one compressed air cylinder 15 with a booster 18 located on the outside of the guide body 12 and by means of which the suction nozzle 13 can be moved between the retracted position shown in FIG. 2 and the downwardly extended position shown in FIG. 3.

On the lower end of the suction nozzle 13 is formed a tooth system 16 with which the suction nozzle 13 engages in the soil and can loosen the latter. With the tooth system 16 is associated a removable cap 17, which can be used for covering the tooth system.

When operating the suction dredge 1 the operator grips the guide body 12 by the gripping frame 14 and guides it just above the soil area to be taken up. The suction nozzle 13 is then automatically moved downwards as a result of the compressed air cylinder 15, engages with the soil and after a short time is raised from the latter again and retracted into the guide body 12. The stroke frequency of the suction nozzle 13, its stroke length and therefore the impact energy on the soil can be preset by means of a control device 6 (FIG. 1).

On the gripping frame 14 is provided a selector switch 7 by means of which the operator can switch on or off, as desired, the booster 18. The operator can also set the control device 6 to the medium to be sucked up by means of the selector switch 7.

What is claimed is:

1. A suction dredge which suctions ground material comprising:

a suction hose which suctions up the ground material, a suction stub disposed at one end of the suction hose, a collecting tank coupled to another end of the suction hose which receives suctioned ground material from the suction hose and a control device; and wherein the suction stub comprises an upper guide body coupled to the one end of the suction hose and a suction nozzle extending downwardly therefrom which reciprocates axially while extended from the guide body under control of the control device to inpact and loosen the ground material.

2. A suction dredge according to claim 1, wherein:

the suction nozzle is guided on the guide body.

3. A suction dredge according to claim 1, wherein:

the guide body has a grip.

4. A suction dredge according to claim 3, wherein:

the grip comprises a gripping frame surrounding the guide body.

5. A suction dredge according to claim 1, wherein:

the guide body is electrically insulated from the suction nozzle.

6. A suction dredge according to claim 3, wherein:

the grip is electrically isolated from the suction nozzle.

7. A suction dredge according to claim 1, wherein:

the drive mechanism comprises a piston-cylinder unit.

8. A suction dredge according to claim 7, wherein:

the piston-cylinder unit is associated with an adjustable booster to provide power to the piston-cylinder unit.

9. A suction dredge according to claim 8, wherein:

the adjustable booster is removable from the suction dredge.

10. A suction dredge according to claim 1, further comprising:

a control device which adjusts at least one of stroke frequency, stroke length, or impact energy of the suction nozzle to loosen the ground material.

11. A suction dredge according to claim 10, wherein:

the control device provides selection of suction media parameter values for the stroke frequency and stroke length to control impact energy.

12. A suction dredge according to claim 10, further comprising:

a selector switch which provides selection of operation with a plurality of suction media causing the control device and/or booster to be controlled as a function of the position of the selector switch.

13. A suction dredge according to claim 10, further comprising:

a sensor which detects penetration depth of the suction nozzle in the ground material and provides the control device with a corresponding penetration signal to cause the control device to penetrate the ground material in accordance with the penetration signal.

14. A suction dredge according to claim 13, wherein:

the control device, as a function of the penetration signal, connects to the booster.

15. A suction dredge according to claim 1, wherein:

a lower end of the suction nozzle has a tooth system, which is selectively covered by a cap.

16. A method of dredging ground material with a suction dredge having a pneumatic suction hose, a suction stub disposed at an end of the suction hose having an upper guide body coupled to one end of the suction hose, a suction nozzle extending downwardly therefrom which reciprocates axially while extending from the guide body, a collecting tank coupled to another end of the suction hose and which receives the material suctioned into the suction hose and a control device which controls reciprocation of the suction nozzle comprising:

reciprocating the extended suction nozzle axially upwardly and downwardly to impact and loosen the ground material; and suctioning the loosened ground material into the nozzle, through the pneumatic suction hose, into the collecting tank.

17. A method in accordance with claim 16, wherein:

the control device adjusts at least one of the stroke length, stroke frequency or impact energy of the suction nozzle to loosen the ground material which is suctioned.

* * * * *